US008966664B2

(12) United States Patent
Walsh

(10) Patent No.: US 8,966,664 B2
(45) Date of Patent: Mar. 3, 2015

(54) GRIPPING AID

(75) Inventor: Stuart David Walsh, Widnes (GB)

(73) Assignee: Gripaid Limited, Widnes, Cheshire (GB)

( * ) Notice: Subject to any disclaimer, the term of this patent is extended or adjusted under 35 U.S.C. 154(b) by 0 days.

(21) Appl. No.: 13/704,931

(22) PCT Filed: Jun. 11, 2011

(86) PCT No.: PCT/GB2011/001043

§ 371 (c)(1),
(2), (4) Date: Dec. 17, 2012

(87) PCT Pub. No.: WO2012/007710

PCT Pub. Date: Jan. 19, 2012

(65) Prior Publication Data

US 2013/0112577 A1 May 9, 2013

(30) Foreign Application Priority Data

Jul. 15, 2010 (GB) ..... 1011873.5

(51) Int. Cl.

| | |
|---|---|
| ***A61F 9/00*** | (2006.01) |
| ***A41D 19/00*** | (2006.01) |
| ***A41D 19/015*** | (2006.01) |
| ***A63B 71/14*** | (2006.01) |
| ***B65D 85/18*** | (2006.01) |
| *A41D 19/01* | (2006.01) |

(52) U.S. Cl.

CPC ..... *A41D 19/0037* (2013.01); *A41D 19/01582* (2013.01); *A63B 71/146* (2013.01); *B65D 85/18* (2013.01); *A41D 19/01* (2013.01); *A41D 19/01552* (2013.01); *A63B 2243/0004* (2013.01); *A63B 2243/0029* (2013.01); *A63B 2244/09* (2013.01); *A63B 2244/19* (2013.01)

USPC ..... 2/17

(58) Field of Classification Search

USPC ..... 2/16, 17, 159, 160, 161.1, 162, 161.4, 2/161.5, 161.6, 163

See application file for complete search history.

(56) References Cited

U.S. PATENT DOCUMENTS

| | | | | |
|---|---|---|---|---|
| 3,348,238 A | | 10/1967 | Hydock | |
| 3,520,539 A | * | 7/1970 | Haws | 473/205 |
| 4,796,306 A | * | 1/1989 | Mitchell | 473/205 |
| 4,827,535 A | | 5/1989 | Socey | |

(Continued)

OTHER PUBLICATIONS

PCT/ISA/220 (Notification of Transmittal of the International Search Report and the Written Opinion of the International Searching Authority, or Declaration) dated Oct. 19, 2011, PCT/ISA/210 (International Search Report) dated Oct. 11, 2011, and PCT/ISA/237 (Written Opinion of the International Searching Authority) dated Oct. 11, 2011, for corresponding PCT International Application No. PCT/GB101/001043.

*Primary Examiner* — Tejash Patel

(74) *Attorney, Agent, or Firm* — Heslin Rothenberg Farley & Mesiti P.C.; Victor A. Cardona, Esq.

(57) ABSTRACT

A wearable aid for gripping an item by hand includes a main body shaped to be worn by a user, a strap connected to a first location of the main body and a releasable retaining means at a second location of the main body that is away from the first location. When a user wearing the aid has engaged an item to be gripped, part of the strap can be passed over at least part of one or more fingers of the user's hand and secured to the releasable retaining means in a manner that aids the user in gripping the item.

14 Claims, 3 Drawing Sheets

(56) References Cited

U.S. PATENT DOCUMENTS

| | | | | |
|---|---|---|---|---|
| 5,435,013 | A * | 7/1995 | Davis | 2/161.1 |
| 5,557,805 | A | 9/1996 | Emerson | |
| 5,557,806 | A * | 9/1996 | Caswell et al. | 2/161.1 |
| 5,669,073 | A | 9/1997 | Pellington | |
| 5,845,374 | A | 12/1998 | Briggs | |
| 5,878,438 | A * | 3/1999 | Ragsdale | 2/158 |
| 6,093,165 | A * | 7/2000 | Estwanik | 602/64 |
| 6,553,576 | B1 * | 4/2003 | Knapp | 2/161.6 |
| 2004/0018899 | A1 | 1/2004 | Thiruppathi | |
| 2009/0019617 | A1 | 1/2009 | Dillenschneider | |

* cited by examiner

GRIPPING AID

CROSS REFERENCE TO RELATED APPLICATIONS

This application is a 371 National stage of PCT International Application No. PCT/GB2011/001043 filed on Jun. 11, 2011, and published in English on Jan. 19, 2012 as WO 2012/007710 A1 and claims priority from GB Patent Application No. 10118715 filed on Jul. 15, 2010, the entire disclosures of which are incorporated herein by reference.

The present invention relates to a gripping aid.

More specifically, but not exclusively, it relates to a hand covering that can aid a wearer in gripping an item.

Gripping items with the hands is a necessary part of everyday life—tools such as hammers, spanners and screwdrivers, cleaning implements such as vacuum cleaners and mops, and even personal care items such as toothbrushes all require grip.

Unfortunately, for many people gripping is difficult or even impossible. Elderly people, those suffering from injuries and those with arthritis, for example, may not have the strength in their hands and wrists to effectively grip items, or may even be incapable of holding their hands in a gripped position.

Hand coverings to improve grip are known in the art. CN101513280 to Chenli discloses a glove with pads of gripping material on the fingers, to provide greater friction between the hands and the item to be gripped. US2006282936 to Barlik and Olson discloses a glove with a series of miniature suction cups on the fingertips to provide suction between the hand and the item to be gripped.

Whilst these inventions can help to prevent the item to be gripped to the hand from slipping, they cannot aid in keeping the hand in a gripped position and would therefore not be useful to the elderly, injured or those suffering from arthritis.

It can be seen by the foregoing that a need has arisen for a gripping aid that assists in keeping a hand in a gripped position.

Such an aid can, for example, enable the elderly, injured or those suffering from arthritis to grip items.

It is, however, not limited to use by such people. It can be used by people of many different ages and conditions, whether well or unwell.

Indeed a gripping aid of the present invention is useful for improving grip in a wide variety of circumstances and has an almost limitless number of practical applications.

It represents a significant breakthrough in the art

According to the present invention there is provided an aid for gripping an item by hand, the aid comprising a main body shaped to be worn by a user, a strap connected to a first location of the main body and a releasable retaining means at a second location of the main body that is positioned away from the first location; wherein, when a user wearing the aid has engaged an item to be gripped by hand, part of the strap can be passed over at least part of one or more fingers of the user's hand and secured to the releasable retaining means in a manner that aids the user in gripping the item.

Preferably, when the device is in use, the first and second locations are located at opposite parts (e.g. on opposite faces) of the main body.

More preferably, when the device is in use, the first location is at the front of a hand, wrist or arm and the second location is at the rear of a hand, wrist or arm, or vice versa.

It should be appreciated that the term "hand" is used herein to include the body of the hand as well as the fingers. Thus, for example, in one embodiment of the invention, either the first or second location is at the rear of fingers.

Preferably this is the second location, i.e. the location where the releasable securing means is positioned.

In certain aspects of the invention it is preferred that, when the aid is in use, the strap does not pass over the thumb. This allows the thumb to move to a high degree whilst grip can still be retained.

This distinguishes from alternative systems in which the thumb is relatively immobile (e.g. in which the thumb is strapped to one or more fingers or is otherwise immobilised).

Allowing the thumb to have a significant degree of freedom can reduce strain and aid flexibility. Indeed this can itself aid a user in achieving/maintaining grip. It can also be useful in circumstances where the positioning of the thumb may need to be periodically adjusted.

Thus it is preferred that, when in use, the strap does not contact/lie across the thumb or at least a major part thereof.

Desirably the strap extends over at least one knuckle of at least one finger. More desirably, it extends over at least two knuckles of said at least one finger. Most desirably, it extends over all three knuckles. In most embodiments the strap contacts one or more of said knuckles.

Preferably, it is sufficiently wide so that it extends over at least at least two or at least three knuckles of each of a plurality of fingers. Thus it may extend over knuckles of two, three or even four fingers.

It should be appreciated that the term "strap" is used herein in a broad sense.

It includes traditional straps. However it also includes flaps, ties, meshes, or any other form that allows the strap to perform its function in aiding a hand to grip an item.

The strap may comprise any desired material. Thus, for example it may comprise leather, any other natural material, a man-made material or a composite material. The material may be the same material as used for the main body or may be different.

As indicated above, the strap is connected to the main body at a first location. (The terms "first" and "second" locations are non-limiting, as long as the locations are separate/spaced apart and as long as the strap can fulfil its function.)

It is preferably fixedly attached to the main body at this location. This may be achieved via stitching, adhesive, stapling, riveting, by a combination of the aforesaid, or by any other means of fixedly securing one component to another.

Alternatively, the main body and strap may already be connected to one another when formed. Thus they may be integral components.

Thus for example if the gripping aid is in the form of a moulded glove, the strap may be included as part of the moulding. Similarly the strap may simply be a part of the same fabric or material used to form the main body and it may not be necessary to attach it.

In an alternative to the embodiments discussed above embodiments the strap is releasably attached to the first location. Thus the strap can be releasably attached to both the first and second locations.

This may be useful, for example, if a user wishes to take the strap off when the aid is not used for gripping but still retain the main body.

Preferably the strap is generally elongate.

Thus it will normally having a maximum width when measured across the fingers of a user that is significantly less than the length of the strap between the first and second locations.

For example, the length may be at least 50% longer than the width.

More preferably it is at least 2 times the width. It may, for example be at least 2.5 times the width, at least 3 times the width, at least 3.5 times the width, or at least 4 times the width.

The device is preferably provided in a form so that, when in use, the strap is in general alignment with the fingers, rather than running across the figures (e.g. at right angles thereto).

For example, when the fingers are bent the strap may follow the general curvature of the fingers/be generally aligned therewith. (Unless the context is different, the term "fingers" is generally used herein to refer to fingers of a user or fingers of a glove in which the fingers of the user are present. Thus, in the case of a glove with fingers, the strap does not need to be in direct contact with the fingers of a user but may contact and be aligned with fingers of the glove. A similar interpretation applies in respect of "knuckles", "thumb" and related terminology in respect of parts of a user that may be within a glove.)

Turning now to the main body of the gripping aid, this is shaped to be worn by a user.

Thus it can be shaped to be fitted on, around and/or over a part of the user (e.g. a hand, wrist and/or forearm, or part of any of the aforesaid.)

Preferably the gripping aid comprises a flexible material.

If desired, one or more parts/surfaces that contact an article may be formed of or comprise non-slip material/material that reduces the risk of the article slipping when gripped.

The gripping aid may, if desired, be in the shape of a glove or mitten intended to cover the whole hand of a user, including the fingers.

This is however not essential. It can be in any desired shape, as long as it can be worn and allows the strap and releasable retaining means to fulfil their function.

Thus, for example, the main body may be in the form of a fingerless glove or even a glove that may cover lower parts of fingers, but that has openings ends so that upper parts of fingers protrude there-through.

This type of glove is preferred for certain applications, especially where a high degree of touch sensitivity is desired.

The glove or mitten preferably includes a part that covers the wrist and may even extend to cover all or part of the forearm. This can be useful in applications where a high degree of protection or coverage is desired, although it is not essential for many applications. Thus, if desired, the wrist or a part thereof need not be covered by the main body.

A further possibility to providing a main body aid in the form of a glove or mitten is to provide a main body that is simply worn around the wrist or arm.

For example the main body may be in the form of a wrist-band or arm-band, or a wrist-sheath or arm-sheath. Again this may be formed of any desired material, including leather, other natural materials, synthetic materials, composite materials etc. Indeed the main body may even be in the form of a bracelet or cuff As for the glove or mitten, a strap may be connected to one part of the main body and, in use may be releasably secured to another part (preferably at the other side of the am or wrist) so as to aid gripping.

Here, however, the strap may often be longer than for a glove or mitten, given that the distance between the first and second locations (measured along the strap when in use) will usually be greater.

It will be appreciated from the foregoing discussion that the gripping aid can be in many different forms.

In one embodiment it is in the form of a hand covering, comprising:

a main body that covers a hand;

a strap extending from the inside of the wrist of said hand covering, said strap being at least as long as the length of said hand covering;

a fastener for said strap located on the back of said hand covering.

In this embodiment the main body is preferably shaped as a glove or mitten.

It may optionally comprise a fleece lining.

If desired, it may comprise grip pads on any of the following areas: the fingers; the thumb or the palm.

The fastener may for example use any of the following means of fastening: a hook and loop fastening; buttons; press studs.

Many other embodiments are of course possible and are within the scope of the invention.

Indeed, as discussed earlier, it is not necessary to provide a covering for all, or even part of the hand as long as the strap can be releasably retained by the retaining means to perform its function.

Any kind of fastener or other releasable retaining means can be used. Thus, for example, in addition to those discussed above, releasable clips, ties, latches, catches, buckles, push-fit components, press-fit components, releasable locks, releasable clamps, etc., can all be used.

A wide range of other releasable retaining means are known to those skilled in the art of clothing and these can all be used in the present invention.

Preferably the releasable retaining means is arranged so that it can be operated by a hand of the user that is not used to grip the item. This allows the gripping aid to be easily used for gripping and also to be easily released.

Thus the releasable retaining means is desirably such so that it can be operated single-handedly.

A releasable retaining means that allows quick release is particularly preferred. For example, hook and loop fasteners (e.g. Velcro™), releasable catches, or other quick release systems are preferred.

It is also possible to provide several releasable retaining means that are spaced from one another (preferably at fixed intervals). This can be can be useful in adjusting tension in the strap.

A further alternative is for a single releasable retaining means to be provided that allows adjustment of tension. For example it may allow the strap to be pulled/wound to increase tension and to be released to reduce tension.

Another possibility is to provide an area of hook/loop fasteners (e.g. of Velcro™) that allows tension to be adjusted by attaching the strap at different position with said area.

In some embodiments the strap may be resiliently deformable. It may have a high degree of stretch. Stretching of the strap may aid in providing tension/in further improving grip.

Thus, for example, the strap may be capable of stretching by at least 10%, at least 25%, at least 50%, at least 75% or at least 100% during use.

A resiliently deformable strap may be provided and may, for example, comprise natural or synthetic elastomeric material (e.g. rubber, Lycra™, etc). It may even comprise one or more springs, although this is less preferred.

It is not however essential that the strap stretches. Any flexible material can be used as long as the strap is strong enough to perform its function.

As discussed earlier, the gripping aid can be used for very many applications.

One possibility is as a sports aid.

For example, the aid may be a golf glove, a ski glove, a glove for holding a bat or racquet, a weight-lifting glove, a fishing glove, or a glove for use in archery. Alternatively it may be in the form of a wrist-band or sheath as described earlier, for use in sport. Wrist bands are, for example, already used in a wide variety of sports and can be adapted for the present invention by incorporating a strap and releasable retaining means.

Another application is as an aid for gripping a tool, a machine, a piece of equipment, a utensil or indeed any another item.

Thus, for example the gripping aid may be used in DIY, in construction, in gardening, in plumbing, in woodworking, in using power tools/hand tools, in gardening etc.

It can be used by professional tradesman/women, professional sportsmen/women or amateurs.

It can be used by people who are physically able so as to aid grip.

[The term "to aid grip" is used to include any desired benefit relative to gripping using a standard glove. The benefit may, for example be increased comfort of grip, increased duration, increased control, increased power, increased precision, increased strength or increased security of grip. It may even be an ability to grip items that the user could not have previously have gripped—e.g. items that might normally be too awkward, large or heavy to grip safely or easily. In some cases increased grip may even provide increased performance, although this is not essential. For example it may provide increased accuracy and/or increased distance in respect of a golf swing if the aid is used to assist a user in gripping a golf club.]

It should also be recalled that the present invention can be a very useful aid for a person suffering from, or at risk of, a disability, injury or a condition that may affect grip.

The disability, injury or condition may, for example, be one affecting muscle, bone, nerves, joints, or the control or coordination of movement.

It can therefore includes sprains, strains, fractures, inflammatory disorders (e.g. arthritis), RSI, muscle-wasting disorders, mental disorders, shaking, neural or brain disorders, etc.

The aid is therefore useful for a wide range of medical purposes. It can also be useful in preventing, treating or ameliorating certain conditions. Thus it can be useful in both prophylaxis and treatment. It can also be useful in rehabilitation following treatment of an injury.

It is particularly useful for elderly or infirm people, who may have difficulty in achieving or maintain a desired grip, whether or not such a person is suffering from a specific disability.

It is not limited to being used to grip specialist items. It can for example be used to grip household/everyday items, e.g. cutlery, cups, plates, toothbrushes, pens, pencils, telephones, etc.

Although it is particularly beneficial for elderly or infirm people, it is not limited to any particular age of user, being generally useful for young, middle aged and elderly people.

Thus the gripping aid of the present invention can be used by, and can benefit, very many users In addition to the aid per se, the invention also includes within its scope a kit comprising the aid and one or more other components.

If a kit is supplied it is preferably provided in a container. The container may be sealed. For example it may be a sealed box, bag or carton.

Additional components of the kit may, for example, include instructions for use of the gripping aid. The instructions may explain or illustrate how the strap is releasably secured and/or released.

If desired, one or more additional gripping aids may be provide in the kit (e.g. a left and a right handed gripping aid may be included, or a spare gripping aid may be included).

The kit may even include the item that the gripping aid is intended to grip. For example it may include one or more tools, machines or sporting items.

By way of illustration, a golf kit may be provided that includes at least one club (preferably a set of clubs) and the gripping aid.

Similarly, a kit for a racquet sport may include a racquet and the gripping aid.

It will be appreciated that the size and shape of the gripping aid, especially of the strap, can vary to take into account the item to be gripped.

For example a gripping aid in the form of a golf glove may be formed of relatively thin material so that a user retains a feel for the golf club. It may have a relatively short strap, because the shaft of a golf club is usually not particularly large.

In contrast, a gripping aid intended for use with a large power tool may be larger, thicker and may have a longer strap.

Preferred gripping aids can be used to assist in griping tightly or loosely. For example a fisherman may wish to grip a rod loosely until a fish is caught and may then wish to tighten the grip. The strap may therefore be adjustable in length (as is known in the art of clothing straps), or the aid may include means for adjusting tension as discussed earlier.

There are very many other possibilities and all are within the scope of the present invention.

In addition to the gripping aid per se and to kits including the gripping aid, the present invention also includes various methods.

Thus it includes a method of gripping an item; whereby a user wearing a gripping aid of the invention engages an article to be gripped with a hand and releasably secures the strap of the gripping aid to the retaining means so that the fingers of the hand are aided in gripping said item.

As indicated earlier the method may be a method is used to improve grip during sport.

It may be a method is used to improve grip on tool, a piece of equipment, or any other item (or any part of any item).

It also includes a method whereby the strap is released from the releasable retaining means, once the user wishes to disengage the item.

The method may be used to aid a person suffering from a disability, injury or condition that affects grip. It may even be used to reduce the likelihood or extent of such a disability, injury or condition that affects grip.

It may even be used to prevent, reduce or avoid pain or discomfort when gripping an item.

The aforesaid hand covering to aid grip can, for example be used. This comprises a main body that covers the hand; a strap extending from the inside of the wrist of the hand covering, the strap being at least as long as the length of the hand covering; a fastener for the strap located on the back of the hand covering.

The user simply places a hand into the hand covering, and positions the hand in a gripped position. The user then extends the strap from the inside of the wrist over the fingers and fastens the strap in place using the fastener on the back of the hand covering. This can force the hand to stay in a gripped position.

An advantage of the present invention is that it can allow the elderly, injured or those suffering from arthritis to continue with daily life without the need for outside assistance in gripping everyday items (although as discussed earlier it is not limited to such uses).

The invention will now be described by way of non limiting example only and with reference to the following drawings, wherein.

EXAMPLE 1

Figure 1:
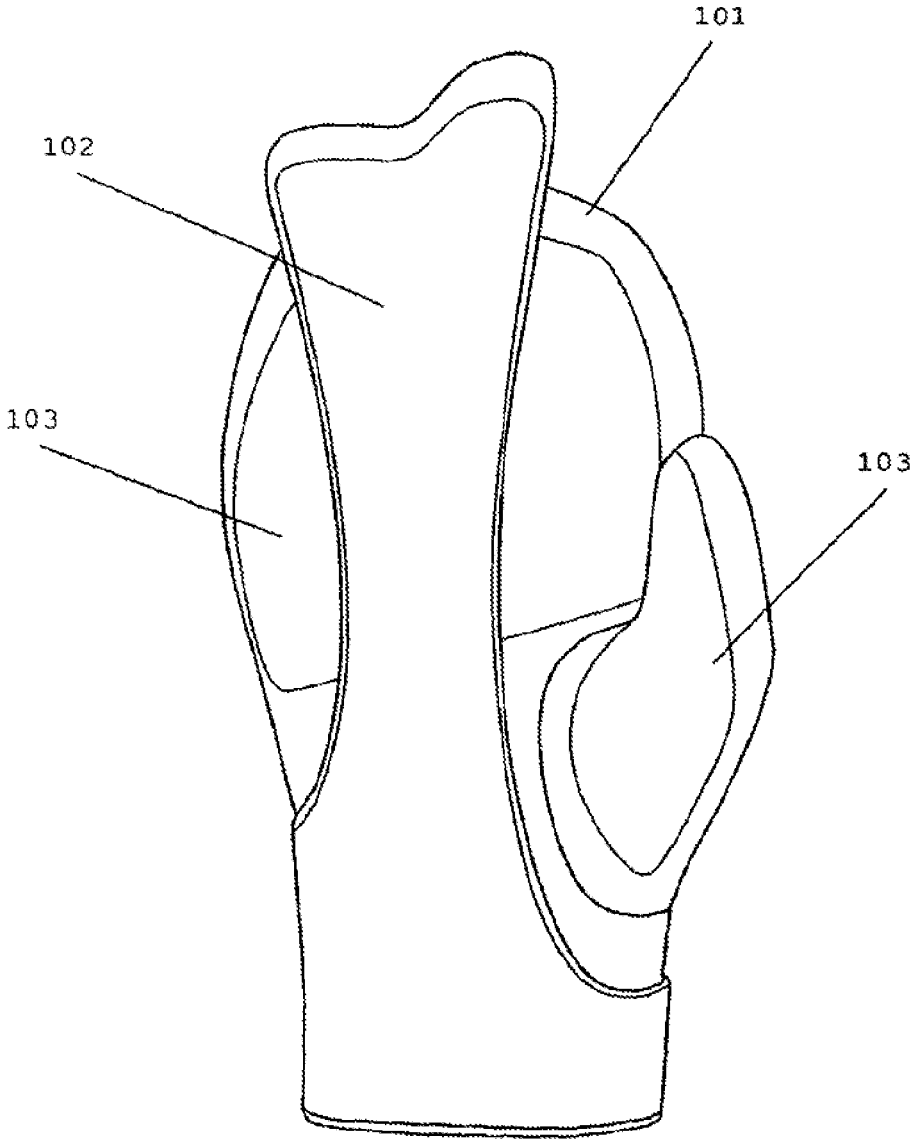
FIG. 1 shows a front view of preferred embodiment of the invention described in Example 1.
Figure 2:
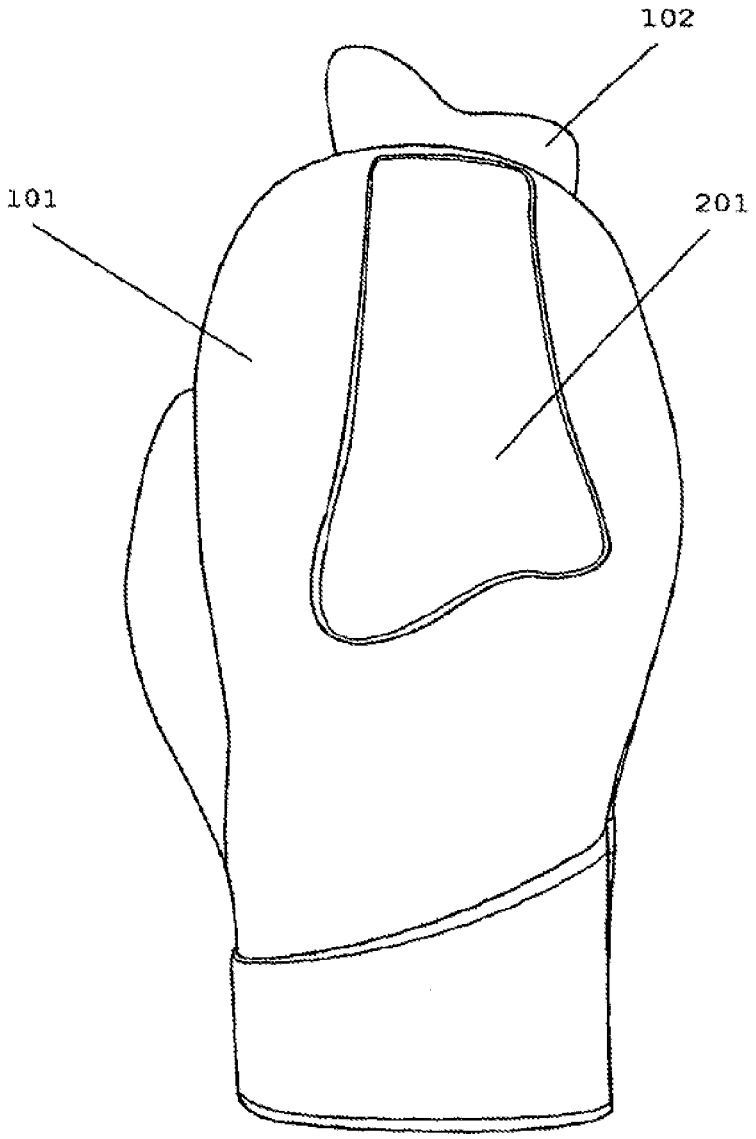
FIG. 2 shows a back view of said preferred embodiment of the invention.

In a preferred embodiment of the invention shown in FIGS. 1 and 2, a hand covering to aid grip is disclosed, comprising: a main body 101 that covers the hand; a strap 102 extending from the inside of the wrist of the hand covering, the strap 102 being at least as long as the length of the hand covering; a fastener 201 for the strap 102 located on the back of the hand covering.

The main body 101 is shown in the drawings as covering the entire hand in a single piece, in the style of a mitten. Alternatively, it may cover each finger individually, in the style of a glove. Any material suitable for making a glove or mitten known in the art, for example cotton, may be used.

The main body 101 may be fleece lined, to provide comfort to the wearer.

The main body 101 may comprise pads of material 103 to provide extra grip to the item to be gripped. These pads 103 may be present on the fingers, thumb or palm of the main body. The pads 103 may be formed of a rubberised material to increase friction, small suction cups to provide suction or any other material suitable to increase grip known in the art.

The strap 102 extends from the inside of the wrist of the main body 101. The strap 102 may be connected to the main body 101 by any suitable means known in the art. The strap 102 should be at least as long as the main body 101 of the hand covering, to ensure that it will extend over the fingers of the wearer. Depending on the nature of the fastener 201 used, discussed below, the inside of the strap 102 facing the palm of the hand may comprise one half of a hook and loop fastener.

The fastener 201 for the strap 102 is shown in the drawings as being a hook and loop fastener.

If this type of fastener 201 is used, one half of the fastener should be on the inside of the strap, facing the palm of the wearer, arid the other should be on the back of the main body 101 of the hand covering, on the outside of the hand. Alternatively, any other suitable method of fastening known in the art may be used, for example, a button or press-stud.

EXAMPLE 2

Figure 3:
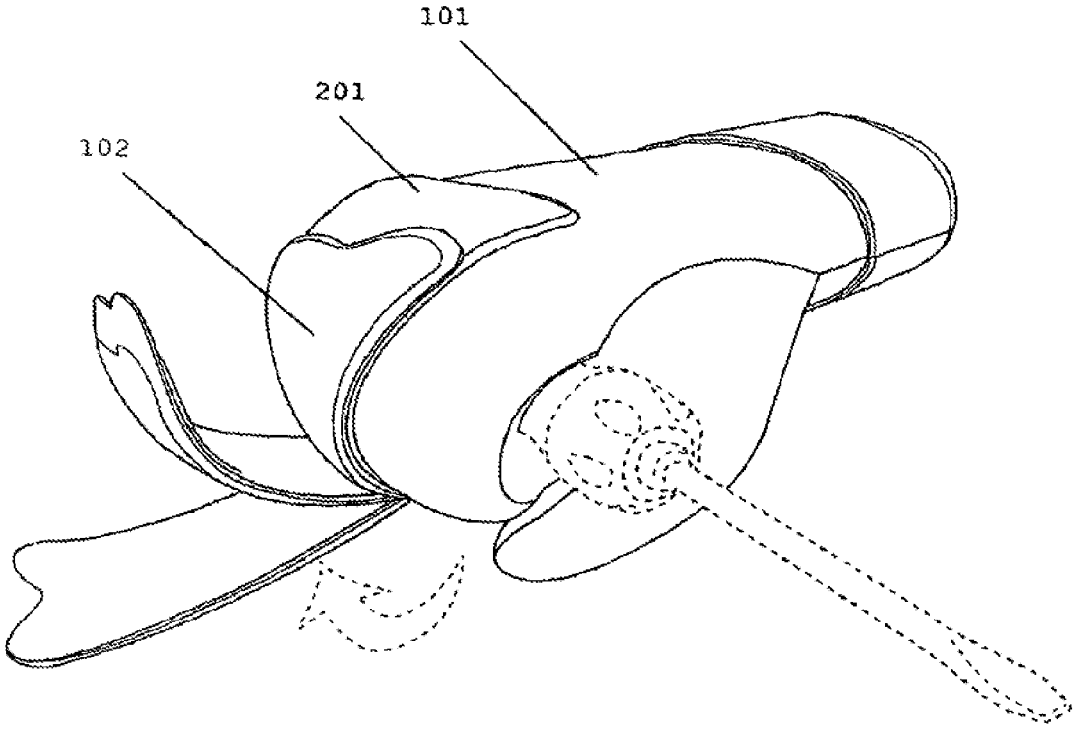
FIG. 3 shows the preferred embodiment of the invention in use.

This embodiment of the invention is generally similar to that shown in FIGS. 1 to 3 and described in Example 1, apart from that, rather than providing a mitten, a glove with separate fingers is provided. The free end of the strap can be releasably secured to one or more fasteners located at the rear of one or more fingers of the glove.

If desired, the strap may fasten to the rear of a single finger (e.g. the index finger). Thus only one finger of the glove need have fastening means. The strap can therefore be narrow at least at the point of fastening.

However it is preferred that the strap is releasably attached to fasteners at the rears of two or more fingers (e.g. of three or all four fingers). Thus a plurality of fingers of the glove may each have a fastener at their rear.

A further alternative is to provide a single fastening region extending over several fingers (e.g. a Velcro pad).

A still further alternative is to provide one or more fasteners on the rear of the glove but below the fingers. Thus, for example, one or more fasteners may be located at the rear hand or at rear wrist part of the glove.

EXAMPLE 3

This embodiment is similar to that described in Example 2, but the glove is a fingerless glove—i.e. one in which the main parts of the fingers protrude through holes in the glove.

Here the strap still extends over fingers of the user that are used to grip the item, but it is secured to a fastener at the rear of the main hand portion of the glove or at the rear wrist portion of the glove.

Thus the strap here is generally longer than in a comparable situation where it would be attached to the rear of one or more fingers.

EXAMPLE 4

In this embodiment no glove or mitten is present but the strap extends from a main body in the form of a wrist or arm band.

As in the foregoing embodiments the strap extends over the fingers of a user when the device is in use.

It is releasably secured to a fastener on the rear of the arm or wrist band.

The strap here is longer than in the previous examples because the fastener of located further way from the point at which the strap is attached to the front of the gripping aid.

EXAMPLE 5

This is as for any of the previous examples apart from the fact that the fastener is located at the front of the main body of the gripping aid rather than the rear. Thus the strap extends in the reverse direction, i.e. from the rear of the main body of the gripping aid, over the fingers towards the front.

The free end of the strap is secured to releasable retaining means located at the front of the main body of the gripping aid.

This may for example be located on a lower part of the front of the hand, on the front of a wrist or on the forearm. Here the wrist and forearm locations are most preferred.

EXAMPLE 6

This is as for any of the previous examples apart from the fact that, prior to use the strap is relatively short, but is resiliently deformable and has a significant degree of stretch. (It may for example include a large number of Lycra™ or other elastomeric fibres.)

The strap is stretched during use in order to attach it to the releasable retaining means. It is then under tension. This can further assist in aiding grip.

The invention claimed is:

1. A wearable aid for gripping an item by hand, the aid comprising:

a main body shaped to be worn by a user, a strap connected to a first location of the main body and releasable retaining means at a second location of the main body away from the first location;

wherein, when a user wearing the aid has engaged an item to be gripped, part of the strap can be extended over three knuckles of at least two fingers and releasably secured to the releasable retaining means in a manner that maintains the strap in said position and aids the user in gripping the item; and wherein, when the device is in use, the first location is at a front palm side of a hand, wrist or arm and the second location is at the rear of a hand, wrist or arm.

2. An aid according to claim 1, wherein, when the device is in use, the strap does not pass over the thumb, thereby allowing the thumb to move whilst grip is still retained.

3. An aid according to claim 1, wherein, when the device is in use, the strap extends over all three knuckles of each of a plurality of fingers.

4. An aid according to claim 1, wherein, when the device is in use, a longitudinal dimension of the strap is in general alignment with longitudinal dimensions of the fingers.

5. An aid according to claim 1, wherein the aid comprises a sports aid.

6. An aid according to claim 5 that is a golf glove, a ski glove, a glove for holding a bat or racquet, a weight-lifting glove, or a fishing glove.

7. An aid according to claim 1, that is an aid for gripping a tool, a machine, a piece of equipment or another item.

8. An aid according to claim 1, that is an aid for a person suffering from a disability, an injury or condition that affects grip.

9. An aid according to claim 8, wherein said condition is ageing, shaking, loss of memory, infirmity or arthritis.

10. A method of gripping an item, whereby a user wearing an aid as described in claim 1, engages an article to be gripped by hand and then releasably secures the strap of the gripping aid to be retaining means so that the fingers of the hand are aided in gripping the item.

11. A kit comprising an aid according to claim 1, and one or more of: instructions for use, a further gripping aid, an item to be gripped, a sealed container.

12. An aid according to claim 1, wherein, when the device is in use, the strap is in general alignment with the fingers.

13. An aid according to claim 1, wherein, the first location is the wrist part of the gripping aid.

14. A method according to claim 10, wherein the method is used for at least one of the following:

a) to aid a person suffering from a disability, injury or another condition that affects grip in gripping an item;
b) to aid grip when gripping sports equipment;
c) to aid grip when gripping a tool; or
d) to aid grip when gripping a utensil or other household item.

* * * * *